US010851662B2

(12) United States Patent
Lee

(10) Patent No.: US 10,851,662 B2
(45) Date of Patent: Dec. 1, 2020

(54) SEALING STRUCTURE FOR TURBINES, AND TURBINE AND GAS TURBINE HAVING THE SAME

(71) Applicant: DOOSAN HEAVY INDUSTRIES & CONSTRUCTION CO., LTD., Changwon-si (KR)

(72) Inventor: Ik Sang Lee, Suwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 134 days.

(21) Appl. No.: 16/019,540

(22) Filed: Jun. 27, 2018

(65) Prior Publication Data

US 2019/0055851 A1 Feb. 21, 2019

(30) Foreign Application Priority Data

Aug. 17, 2017 (KR) ..... 10-2017-0104111

(51) Int. Cl.
*F01D 11/02* (2006.01)
*F01D 11/00* (2006.01)
*F01D 9/04* (2006.01)

(52) U.S. Cl.
CPC ..... *F01D 11/02* (2013.01); *F01D 9/042* (2013.01); *F01D 11/001* (2013.01); *F01D 11/006* (2013.01); *F01D 11/025* (2013.01); *F05D 2240/55* (2013.01); *F05D 2240/80* (2013.01); *F05D 2250/13* (2013.01); *F05D 2250/191* (2013.01); *F05D 2250/71* (2013.01); *F05D 2250/712* (2013.01)

(58) Field of Classification Search
None
See application file for complete search history.

(56) References Cited

U.S. PATENT DOCUMENTS 4,218,189 A * 8/1980 Pask ..... F01D 5/225 277/420
5,029,876 A * 7/1991 Orlando ..... F16J 15/4472 277/419

(Continued)

FOREIGN PATENT DOCUMENTS

JP 2004-332616 A 11/2004
JP 2007-085340 A 4/2007

*Primary Examiner* — Kenneth J Hansen
*Assistant Examiner* — Jason Fountain
(74) *Attorney, Agent, or Firm* — Invenstone Patent, LLC

(57) ABSTRACT

Disclosed herein may be a sealing structure for turbines, and a turbine and a gas turbine having the sealing structure. The sealing structure is mounted on a sealing housing of a vane sealing assembly of the turbine to prevent combustion gas passing through a blade of the turbine from being drawn into an internal space between a disk of the turbine and the sealing housing. The sealing structure may include a mounting plate mounted to the sealing housing, and baffles which are provided on the mounting plate at positions spaced apart from each other and protrude toward the disk. Therefore, thanks to the sealing structure, turbulent currents are generated in the flow of combustion gas that passes through the turbine blade. The generated turbulent currents block space between the sealing structure and the turbine disk, thus preventing the combustion gas from flowing into the internal space.

16 Claims, 10 Drawing Sheets

(56) References Cited

U.S. PATENT DOCUMENTS

| | | | | |
|---|---|---|---|---|
| 7,234,918 | B2 * | 6/2007 | Brillert | F01D 11/001 415/173.5 |
| 7,465,152 | B2 * | 12/2008 | Nigmatulin | F01D 5/20 415/170.1 |
| 8,282,346 | B2 * | 10/2012 | Deodhar | F01D 11/001 415/174.5 |
| 8,939,711 | B2 | 1/2015 | Lee et al. | |
| 8,979,481 | B2 * | 3/2015 | Ingram | F01D 11/04 415/115 |
| 9,765,639 | B2 * | 9/2017 | Kim | F01D 11/02 |
| 2006/0133927 | A1 * | 6/2006 | Brillert | F01D 11/001 415/170.1 |
| 2007/0224035 | A1 * | 9/2007 | Nigmatulin | F01D 5/20 415/170.1 |
| 2010/0254806 | A1 * | 10/2010 | Deodhar | F01D 11/001 415/173.7 |
| 2011/0193293 | A1 * | 8/2011 | Mega | F01D 5/081 277/412 |
| 2013/0108441 | A1 * | 5/2013 | Ingram | F01D 11/04 416/1 |
| 2015/0198053 | A1 * | 7/2015 | Kim | F01D 11/02 415/207 |

* cited by examiner

【FIG. 1】
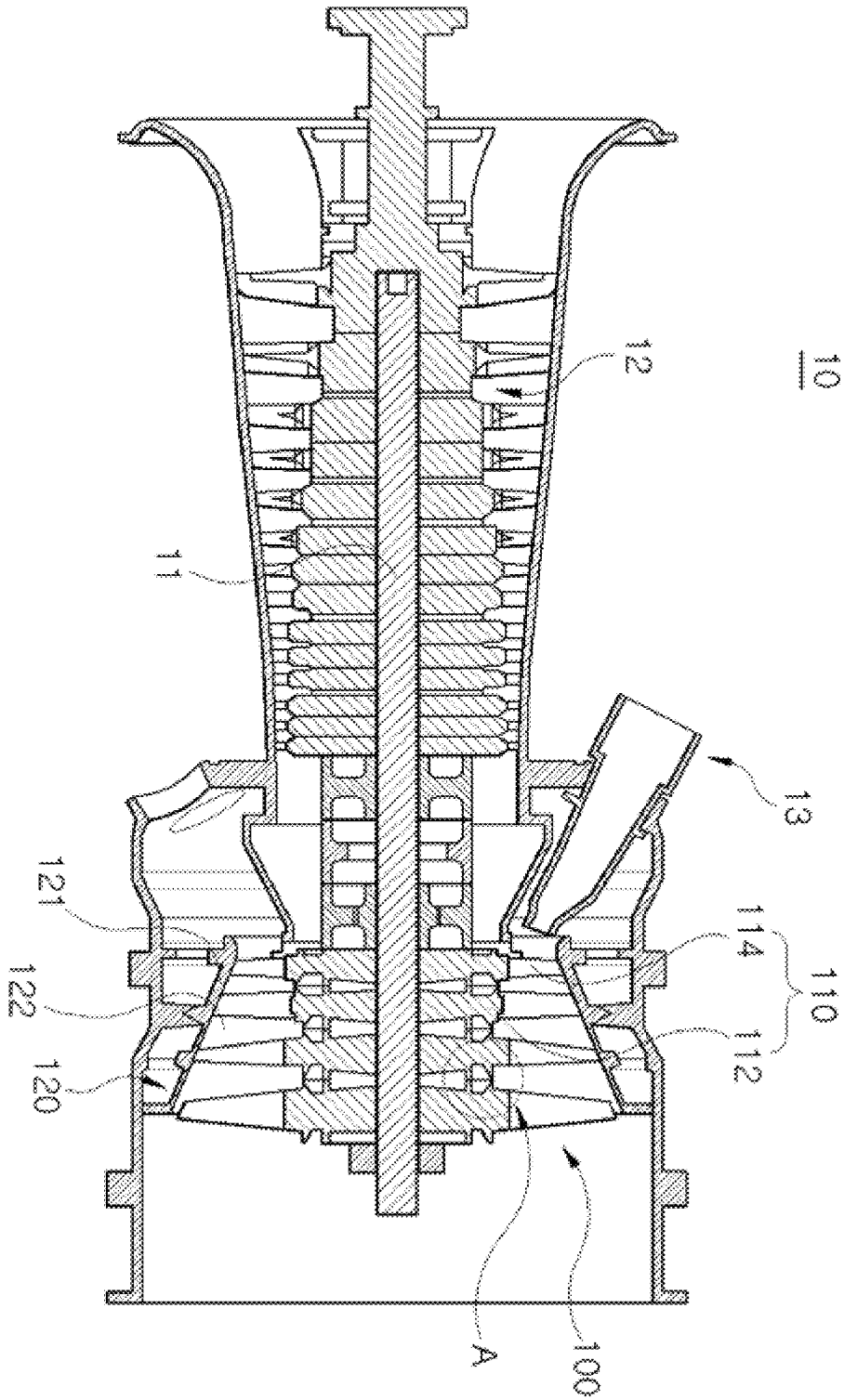

【FIG. 2】
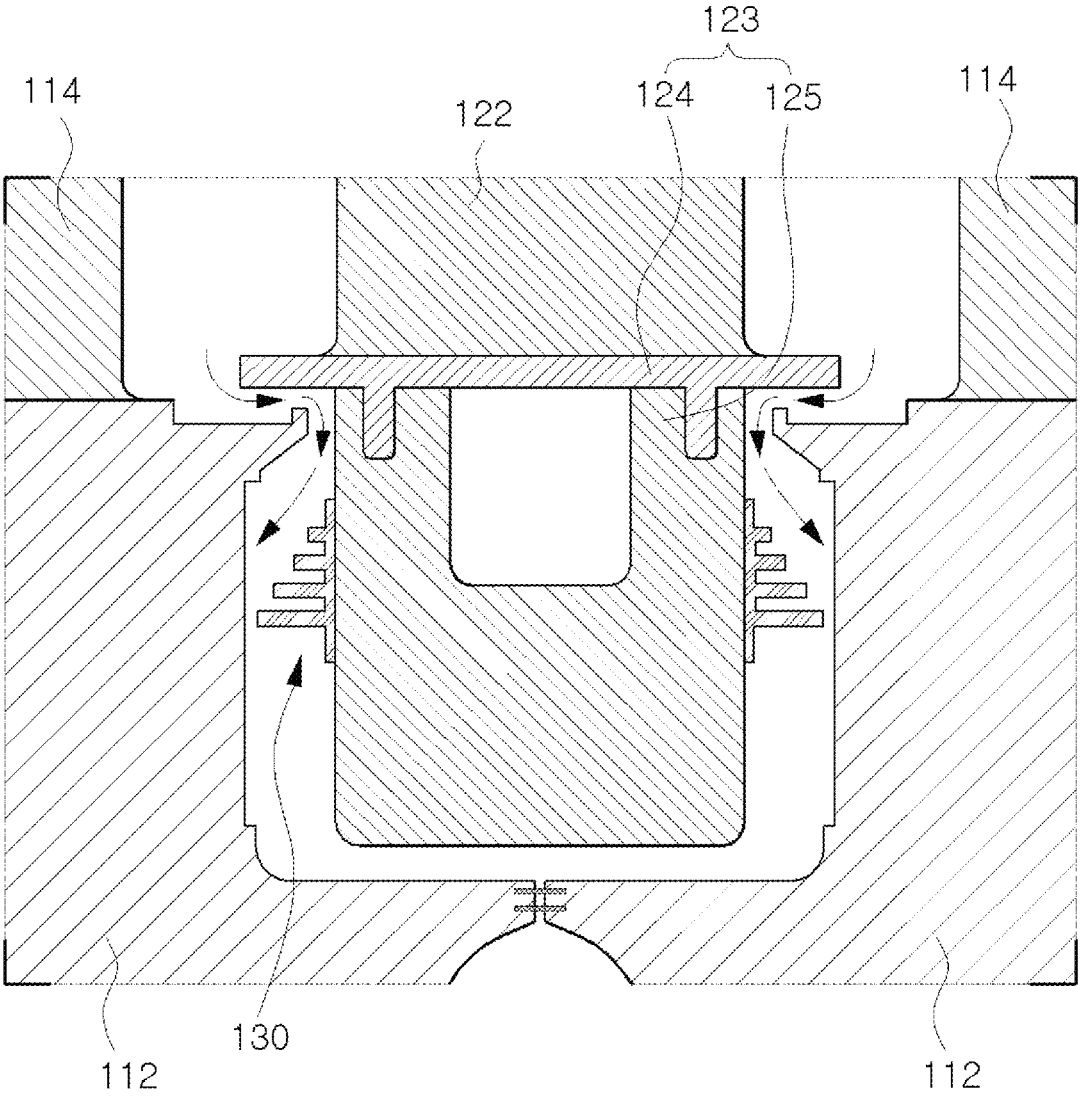

【FIG. 3】
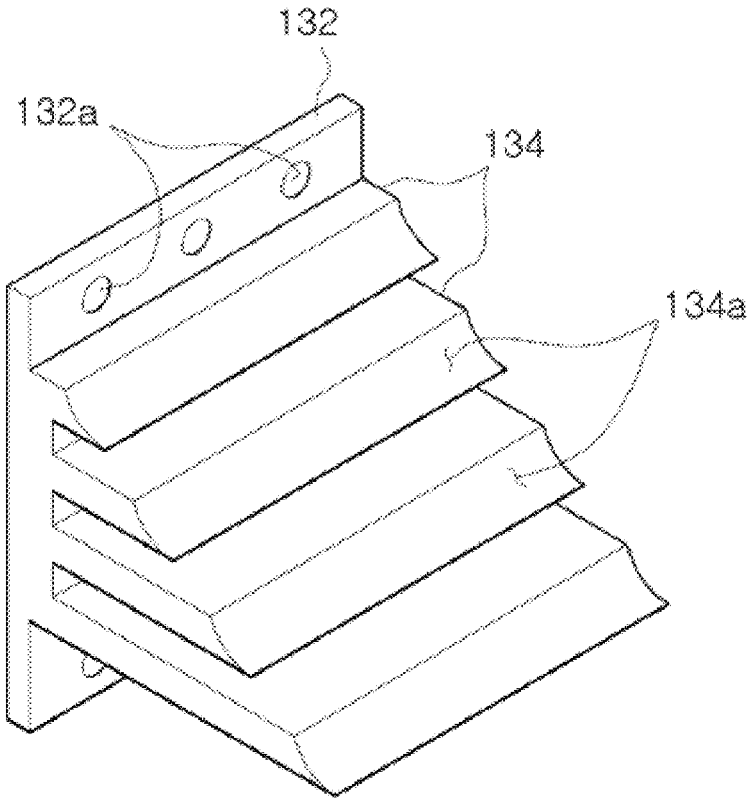

【FIG. 4】
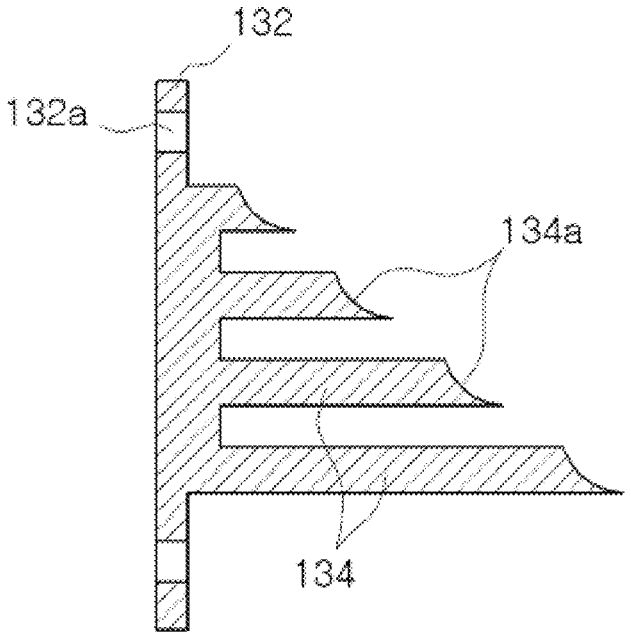

【FIG. 5】
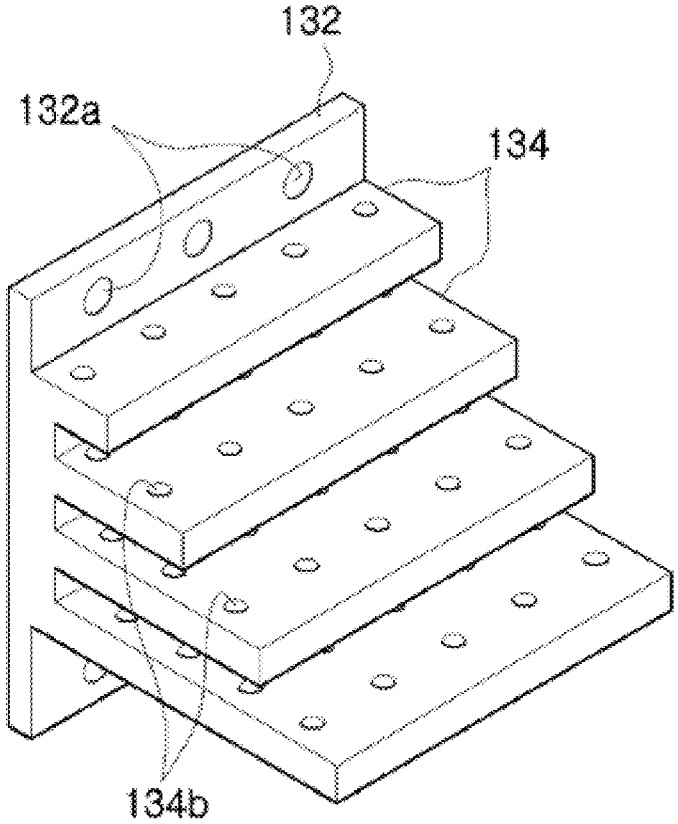

【FIG. 6】
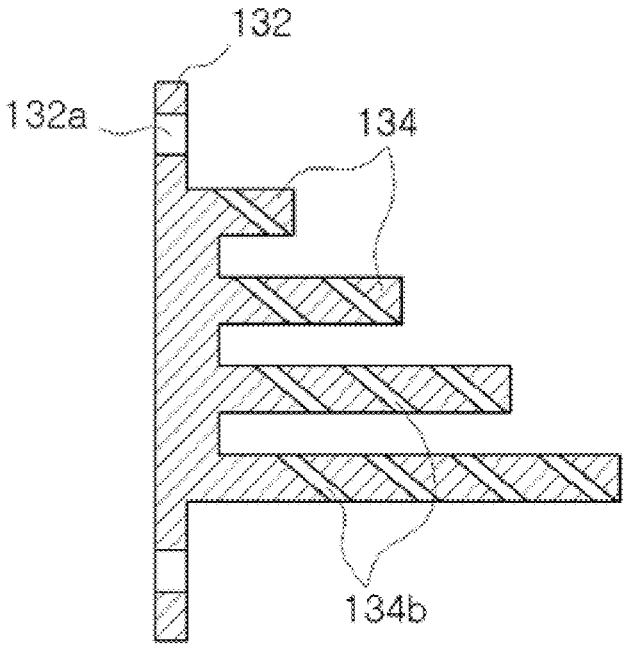

【FIG. 7】
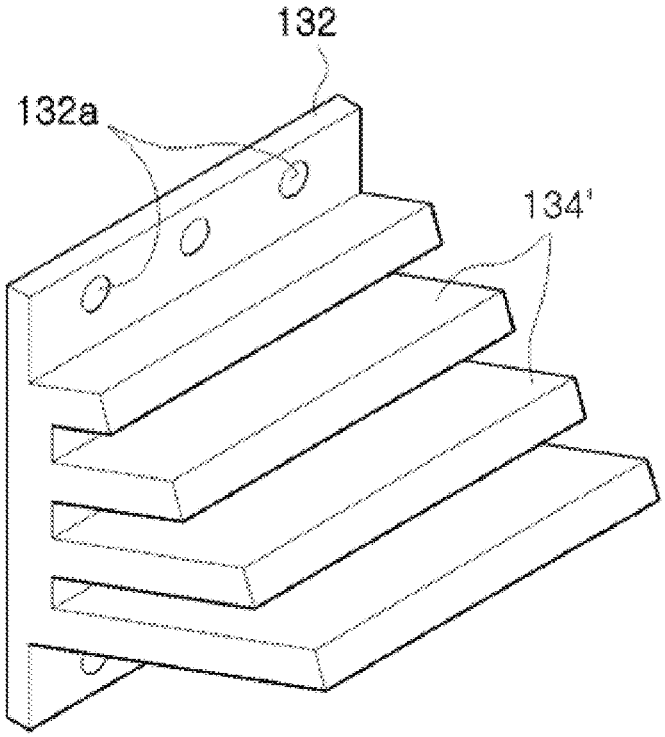

【FIG. 8】
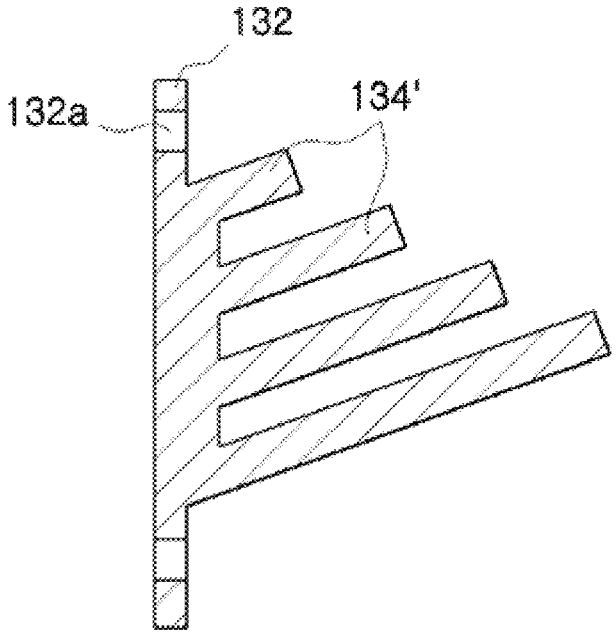

【FIG. 9】
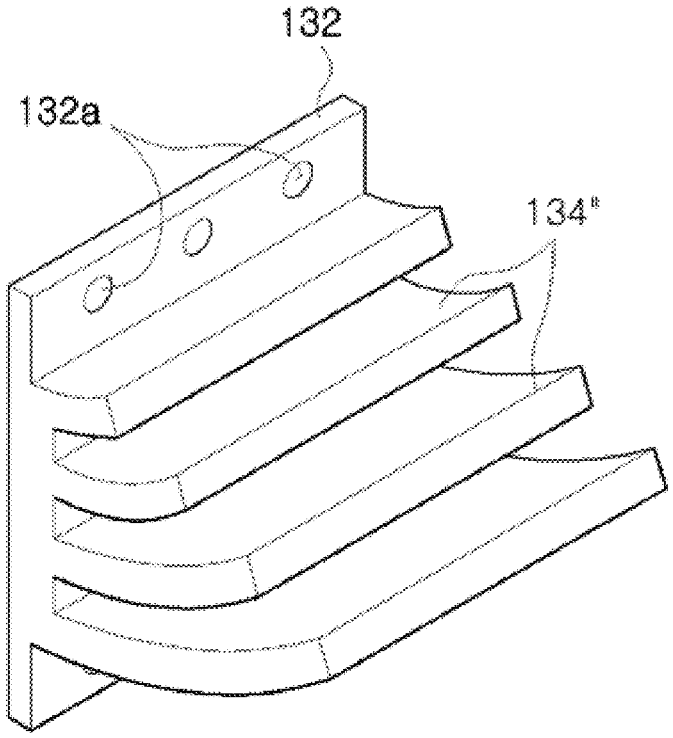

【FIG. 10】
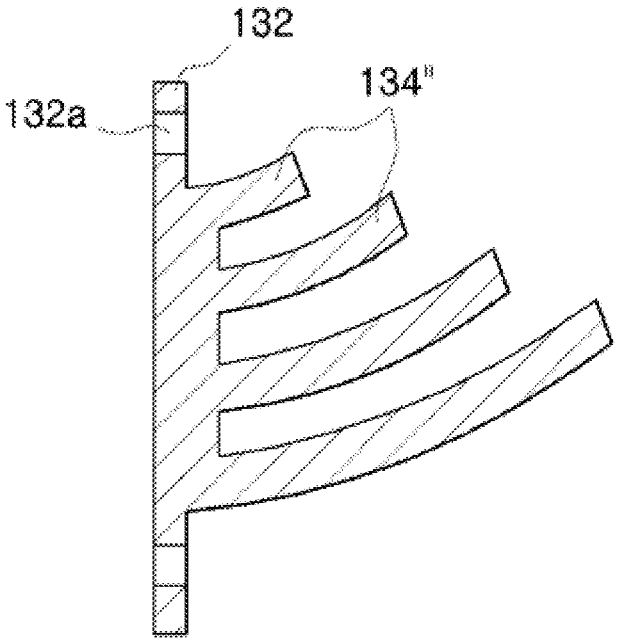

SEALING STRUCTURE FOR TURBINES, AND TURBINE AND GAS TURBINE HAVING THE SAME

CROSS-REFERENCE TO RELATED APPLICATION

This application claims priority to Korean Patent Application No. 10-2017-0104111, filed on Aug. 17, 2017, the disclosure of which is incorporated herein by reference in its entirety.

BACKGROUND OF THE DISCLOSURE

Field of the Disclosure

Exemplary embodiments of the present disclosure relate to a sealing structure for turbines, and a turbine and a gas turbine having the sealing structure. More particularly, the exemplary embodiments relate to a sealing structure for turbines capable of preventing combustion gas passing through a blade of a turbine from being drawn into space between a disk and a vane sealing assembly, and a turbine and a gas turbine having the sealing structure.

Description of the Related Art

A turbine is a machine which generates a rotating force from an impulsive force or reaction force using a flow of compressive fluid such as steam or gas. The turbine is classified into a steam turbine using steam, a gas turbine using high-temperature combustion gas, and so forth. The gas turbine chiefly includes a compressor, a combustor, and a turbine. The compressor includes an air inlet into which air is introduced and a plurality of compressor vanes and compressor blades which are alternately provided in a compressor casing.

The combustor is configured to supply fuel to air compressed by the compressor and ignite the fuel mixture using a burner, thus generating high-temperature and high-pressure combustion gas.

The turbine includes a plurality of turbine vanes and a plurality of turbine blades which are alternately arranged in a turbine casing. Furthermore, a rotor is disposed through central portions of the compressor, the combustor, the turbine, and an exhaust chamber.

Opposite ends of the rotor are rotatably supported by bearings. A plurality of disks are fixed to the rotor, and the blades are coupled to the corresponding disks, respectively. A driving shaft of a generator or the like is coupled to an end of the rotor that is adjacent to the exhaust chamber.

The gas turbine does not have a reciprocating component, such as a piston of a four-stroke engine. Therefore, mutual friction parts, such as a piston-and-cylinder, are not present so that there is little consumption of lubricant, the amplitude of vibration is markedly reduced unlike a reciprocating machine having high-amplitude characteristics, and high-speed driving is possible.

A brief description of the operation of the gas turbine is as follows. Air compressed by the compressor is mixed with fuel, the fuel mixture is combusted to generate high-temperature combustion gas, and the generated combustion gas is discharged to the turbine. The discharged combustion gas passes through the turbine vanes and the turbine blades and generates a rotating force, by which the rotor is rotated.

SUMMARY OF THE DISCLOSURE

In the conventional gas turbine, a sealing housing is provided to seal space between disks of the turbine. However, the conventional gas turbine is problematic in that combustion gas that is supplied from the combustor and passes through the turbine blades is drawn into space between the disks and the sealing housing.

Various embodiments of the present disclosure are directed to a sealing structure for turbines capable of generating turbulent currents in the flow of combustion gas that passes through a turbine blade and is to be drawn into internal space between a turbine disk and a sealing housing, thus preventing the combustion gas from flowing into the internal space, and a turbine and a gas turbine having the sealing structure.

In accordance with one aspect of the present disclosure, a sealing structure for a turbine, the sealing structure being mounted on one surface of a sealing housing of a vane sealing assembly of the turbine so as to prevent combustion gas passing through a blade of the turbine from being drawn into an internal space between a disk of the turbine and the sealing housing, wherein the sealing structure may include: a mounting plate mounted to the sealing housing; and a plurality of baffles provided on the mounting plate at positions spaced apart from each other with respect to a direction from an upper end of the mounting plate to a lower end thereof, the plurality of baffles protruding toward the disk.

In an embodiment, the plurality of baffles provided on the mounting plate may have lengths different from each other. The length of the baffle that is provided on the upper end of the mounting plate may be shortest. The lengths of the baffles may be gradually increased from the upper end of the mounting plate to the lower end thereof.

In an embodiment, the plurality of baffles may be integrally formed with the mounting plate.

In an embodiment, an inducing depression for inducing a flow of combustion gas which is drawn into the internal space may be formed in each of the plurality of baffles. The inducing depression may be formed in a rounded shape in an end of the baffle.

In an embodiment, a plurality of inducing holes for inducing a flow of combustion gas which is drawn into the internal space may be respectively formed in the plurality of baffles. Each of the inducing holes may be formed in the corresponding baffle in an inclined direction.

In an embodiment, the plurality of baffles may protrude from one surface of the mounting plate in an upwardly inclined direction.

In an embodiment, the plurality of baffles may be formed on one surface of the mounting plate in an upwardly rounded shape.

In accordance with another aspect of the present disclosure, a turbine configured to allow combustion gas supplied from a combustor to pass through an interior of the turbine to generate driving force for generating electric power, the turbine including: a rotor comprising a plurality of disks, and a plurality of blades respectively coupled to outer surfaces of the plurality of disks; a stator comprising a casing for housing the rotor therein, a plurality of vanes installed on an inner circumferential surface of the casing and disposed between the plurality of blades, and a vane sealing assembly installed on an end of each of the vanes; and a sealing structure mounted to the vane sealing assembly and configured to prevent combustion gas passing through the blades from being drawn into an internal space between the corresponding disk and the vane sealing assembly.

In an embodiment, the vane sealing assembly may include: a shroud coupled to an end of the turbine vane; and a sealing housing coupled to the shroud and configured to seal space between the corresponding disks, wherein the sealing structure may be mounted to the sealing housing.

In an embodiment, the sealing structure may include: a mounting plate mounted to the sealing housing; and a plurality of baffles provided on the mounting plate at positions spaced apart from each other with respect to a direction from an upper end of the mounting plate to a lower end thereof, the plurality of baffles protruding toward the disk. The plurality of baffles provided on the mounting plate may have lengths different from each other. The length of the baffle that is provided on the upper end of the mounting plate may be shortest. The lengths of the baffles may be gradually increased from the upper end of the mounting plate to the lower end thereof.

In an embodiment, an inducing depression for inducing a flow of combustion gas which is drawn into the internal space may be formed in each of the plurality of baffles. The inducing depression may be formed in a rounded shape in an end of the baffle.

In an embodiment, a plurality of inducing holes for inducing a flow of combustion gas which is drawn into the internal space may be respectively formed in the plurality of baffles. Each of the inducing holes may be formed in the corresponding baffle in an inclined direction.

In an embodiment, the plurality of baffles may protrude from one surface of the mounting plate in an upwardly inclined direction.

In an embodiment, the plurality of baffles may be formed on one surface of the mounting plate in an upwardly rounded shape.

In accordance with yet another aspect of the present disclosure, a gas turbine including: a compressor configured to draw air thereinto and compress the air; a combustor configured to combust fuel using compressed air supplied from the compressor and generate combustion gas; and a turbine. The turbine may include: a rotor configured to be rotated by the combustion gas supplied from the combustor, and comprising a plurality of disks, and a plurality of blades respectively coupled to outer surfaces of the plurality of disks; a stator comprising a casing for housing the rotor therein, a plurality of vanes installed on an inner circumferential surface of the casing and disposed between the plurality of blades, and a vane sealing assembly installed on an end of each of the vanes; and a sealing structure mounted to the vane sealing assembly and configured to prevent combustion gas passing through the blades from being drawn into an internal space between the corresponding disk and the vane sealing assembly.

In an embodiment, the vane sealing assembly may include: a shroud coupled to an end of the turbine vane; and a sealing housing coupled to the shroud and configured to seal space between the corresponding disks. The sealing structure may include: a mounting plate mounted to the sealing housing, and a plurality of baffles provided on the mounting plate at positions spaced apart from each other with respect to a direction from an upper end of the mounting plate to a lower end thereof, the plurality of baffles protruding toward the disk. The plurality of baffles provided on the mounting plate may have lengths different from each other. The length of the baffle that is provided on the upper end of the mounting plate may be shortest. The lengths of the baffles may be gradually increased from the upper end of the mounting plate to the lower end thereof.

In an embodiment, an inducing depression for inducing a flow of combustion gas which is drawn into the internal space may be formed in each of the plurality of baffles. The inducing depression may be formed in a rounded shape in an end of the baffle.

In an embodiment, a plurality of inducing holes for inducing a flow of combustion gas which is drawn into the internal space may be respectively formed in the plurality of baffles. Each of the inducing holes may be formed in the corresponding baffle in an inclined direction.

In an embodiment, the plurality of baffles may protrude from one surface of the mounting plate in an upwardly inclined direction.

In an embodiment, the plurality of baffles may be formed on one surface of the mounting plate in an upwardly rounded shape.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a diagram illustrating a schematic structure of a gas turbine to which a sealing structure for a turbine in accordance with an embodiment of the present disclosure is applied;

FIG. 2 is an exploded view of portion A in FIG. 1;

FIG. 3 is an exploded view of the sealing structure for the turbine shown in FIG. 2;

FIG. 4 is a sectional view illustrating the sealing structure shown in FIG. 3;

FIG. 5 is a perspective view illustrating a first modification of the sealing structure for the turbine shown in FIG. 3;

FIG. 6 is a sectional view illustrating the sealing structure in accordance with the first modification of FIG. 5;

FIG. 7 is a perspective view illustrating a second modification of the sealing structure for the turbine shown in FIG. 3;

FIG. 8 is a sectional view illustrating the sealing structure in accordance with the second modification of FIG. 7;

FIG. 9 is a perspective view illustrating a third modification of the sealing structure for the turbine shown in FIG. 3; and FIG. 10 is a sectional view illustrating the sealing structure in accordance with the third modification of FIG. 9.

DESCRIPTION OF SPECIFIC EMBODIMENTS

Hereinafter, a sealing structure for turbines, and a turbine and a gas turbine having the sealing structure in accordance with the present disclosure will be described with reference to the accompanying drawings.

Referring to FIG. 1, a gas turbine 10 in accordance with an embodiment of the present disclosure includes a tie rod 11, a compressor 12, a combustor 13, and a turbine 100. The tie rod 11 is a rod installed through a central portion of the gas turbine 10. The tie rod 11 functions to couple the compressor 12 with the turbine 100.

The compressor 12 functions to draw air thereinto and compress the air. Based on the direction of air flow, the compressor 12 is installed in an upstream portion of the gas turbine 10. The combustor 13 functions to combust fuel supplied from an external fuel tank (not shown) using compressed air supplied from the compressor 12, and supply combustion gas generated by combustion of the fuel to the turbine 100.

The turbine 100 allows the combustion gas supplied from the combustor 13 to pass through an interior of the turbine to generate a driving force for generating electric power. The turbine 100 includes a rotor 110, a stator 120, and a sealing structure 130 (See FIG. 2).

The rotor 110 is rotated by combustion gas supplied from the combustor 13. The rotor 110 includes a plurality of disks 112, and a plurality of blades 114. The plurality of disks 112 are installed on an outer circumferential surface of the tie rod 11. The plurality of blades 114 are respectively coupled to radial outer surfaces of the plurality of disks 112. Combustion gas drawn into the turbine 100 pushes the blades 114 while passing through the blades 114, whereby the blades 114 and the disks 112 rotate with the tie rod 11 functioning as a center axis.

The stator 120 functions to provide a path enabling combustion gas that has passed through each pre-stage blade 114 to be supplied to a corresponding rear-stage blade 114. The stator 120 includes a casing 121, a plurality of vanes 122, and a vane sealing assembly 123 (See FIG. 2).

The casing 121 houses the rotor 110 therein. The plurality of vanes 122 are installed on an inner circumferential surface of the casing 121 toward the tie rod 11. Preferably, the plurality of vanes 122 may be disposed between the plurality of blades 114.

Referring to FIG. 2, the vane sealing assembly 123 is installed on an end of each of the plurality of vanes 122. The vane sealing assembly 123 includes a shroud 124 and a sealing housing 125. The shroud 124 is coupled to the end of the vane 122. The sealing housing 125 is coupled to the shroud 124 and disposed in space defined between the adjacent pre-stage disk 112 and the adjacent rear-stage disk 112 so as to seal the space.

The sealing structure 130 is mounted on one surface of the sealing housing 125. The sealing structure 130 functions to prevent combustion gas that has passed through the blades 114 from being drawn into internal space between the corresponding disk 112 and the sealing housing 125 of the vane sealing assembly 123.

The sealing structure 130 includes a mounting plate 132 and a plurality of baffles 134 (See FIG. 3). The mounting plate 132 has a planar shape and is mounted on the one surface of the sealing housing 125. It is preferable that the mounting plate 132 be mounted on one surface of the sealing housing 125 by a coupling unit (not shown) or welding.

Preferably, in the case where the mounting plate 132 is mounted to the sealing housing 125 using the coupling unit (not show), a through hole 132*a* through which the coupling unit (not shown) passes may be formed in the mounting plate 132. It is preferable that a plurality of through holes 132*a* be formed in the mounting plate 132 so that the mounting plate 132 can be reliably mounted to the sealing housing 125.

A plurality of baffles 134 protruding toward the disk 112 are provided on one surface of the mounting plate 132. It is preferable that the plurality of baffles 134 be arranged on one surface of the mounting plate 132 at positions spaced apart from each other from an upper end of the one surface of the mounting plate 132 to a lower end thereof. The plurality of baffles 134 have lengths different from each other. Preferably, the baffle 134 that is provided on the upper end of the mounting plate 132 may be the shortest, and the lengths of the baffles 134 may be gradually increased from the upper end of the mounting plate 132 to the lower end thereof. Preferably, the length of the baffle 134 provided on the lower end of the mounting plate 132 may be the longest.

Referring to FIGS. 3 to 6, preferably, the mounting plate 132 and the plurality of baffles 134 are integrally formed. It is preferable that inducing depressions 134*a* or inducing holes 134*b* be respectively formed in the plurality of baffles 134 so that turbulent currents can be generated in the flow of combustion gas that has passed through the blades 114 and is to be drawn into the internal space between the corresponding disk 112 and the sealing housing 125.

Referring to FIGS. 3 and 4, the inducing depressions 134*a* for generating the turbulent currents in the flow of combustion gas drawn into the internal space are respectively formed at the ends of the respective baffles 134. The inducing depressions 134*a* formed at the end of each baffle 134 have a rounded shape. Due to the rounded inducing depression 134*a*, the flow of combustion gas drawn onto an upper portion of the baffle 134 is induced to a side surface of the baffle 134 and then collides with one surface of the disk 112, thus generating the turbulent currents.

Referring to FIGS. 5 and 6, the inducing holes 134*b* for generating the turbulent currents in the flow of combustion gas drawn into the internal space are formed in the respective baffles 134. Preferably, the inducing hole 134*b* formed in each baffle 134 may have an inclined shape. Due to the inducing holes 134*b*, the flow of combustion gas drawn onto the upper portion of the baffle 134 is induced to the side surface of the baffle 134 and then collides with one surface of the disk 112, thus generating the turbulent currents.

The present disclosure is not limited to the structure in which only either the inducing depression 134*a* or the inducing hole 134*b* is formed in each baffle 134. In order to increase the effect of generating turbulent currents in the flow of combustion gas to be drawn into the internal space, both the inducing depression 134*a* and the inducing hole 134*b* may be formed in each baffle 134.

Referring to FIGS. 7 and 8, a plurality of baffles 134' may be formed to protrude from one surface of the mounting plate 132 in an upwardly inclined direction. Due to the plurality of baffles 134' protruding in the upwardly inclined direction, the flow of combustion gas drawn onto an upper portion of each baffle 134' is induced to a side surface of the baffle 134' and then collides with one surface of the corresponding disk 112, thus generating turbulent currents. The generated turbulent currents block space between the sealing structure 130 and the corresponding turbine disk 112, thereby preventing combustion gas from flowing into the internal space between the turbine disk 112 and the sealing housing 125.

Referring to FIGS. 9 and 10, the plurality of baffles 134" may be formed on one surface of the mounting plate 132 in an upwardly rounded shape. Due to the plurality of baffles 134" formed to protrude in the upwardly rounded shape, the flow of combustion gas drawn onto an upper portion of each baffle 134" is induced to a side surface of the baffle 134" and then collides with one surface of the corresponding disk 112, thus generating turbulent currents.

The present disclosure is not limited to the structure in which the baffles 134' or 134" protrude from the one surface of the mounting plate 132 in an inclined or rounded shape. For example, either or both the inducing depression 134*a* and the inducing hole 134*b* may be formed in each baffle 134' or 134" so that the flow of combustion gas drawn onto the upper portion of the baffle 134' or 134" can be more effectively induced to the side surface of the baffle 134' or 134" and then collide with the one surface of the corresponding disk 112 to generate the turbulent currents.

The disks 112 are rotational bodies which rotate along with the blades 114 when the blades 114 rotate. The vane 122, the shroud 124, and the sealing housing 125 are fixed on the casing 121, i.e., which is a stationary body against the rotation of the blades 114.

When the disks 112 rotate at high speeds, some combustion gas may be drawn into space between the disks 112 and the sealing housing 125 and flow into the internal space. Here, the sealing structure 130 mounted on one surface of the sealing housing 125 generates turbulent currents in the flow of combustion gas that is drawn into space between the corresponding disk 112 and the sealing housing 125 and flows into the internal space. The generated turbulent currents block the space between the sealing structure 130 and the turbine disk 112, thus preventing the combustion gas from flowing into the internal space between the turbine disk 112 and the sealing housing 125.

Various embodiments of the present disclosure may provide a sealing structure for turbines, and a turbine and a gas turbine having the sealing structure. In the embodiments of the present disclosure, thanks to the sealing structure mounted to the sealing housing, turbulent currents are generated in the flow of combustion gas that passes through the turbine blade and is to be drawn into the internal space between the turbine disk and the sealing housing. The generated turbulent currents block space between the sealing structure and the turbine disk, thus preventing the combustion gas from flowing into the internal space between the turbine disk and the sealing housing.

While the present disclosure has been described with respect to the specific embodiments, it will be apparent to those skilled in the art that various changes and modifications may be made without departing from the spirit and scope of the disclosure as defined in the following claims.

What is claimed is:

1. A sealing structure for preventing combustion gas passing through a turbine blade of a turbine from being drawn into an internal space between a turbine disk of the turbine and a vane sealing assembly of the turbine, the sealing structure comprising:

a mounting plate mounted to an axially facing surface of the vane sealing assembly, the axially facing surface disposed in opposition to the turbine disk, the mounting plate having a planar shape and including a first mounting flange formed at a radially outer end of the mounting plate and a second mounting flange formed at a radially inner end of the mounting plate; and a plurality of baffles protruding from the mounting plate toward the turbine disk, the plurality of baffles spaced apart from each other and arranged in a radial direction between the first and second mounting flanges, wherein each of the plurality of baffles has a distal end disposed toward the turbine disk and a length measured from a surface of the mounting plate to the distal end, the respective lengths of the plurality of baffles being different from each other and gradually increasing from the radially outer end of the mounting plate to the radially inner end of the mounting plate, and wherein the plurality of baffles includes a shortest baffle disposed nearest the radially outer end of the mounting plate.

2. The sealing structure according to claim 1, wherein the plurality of baffles are integrally formed with the mounting plate.

3. The sealing structure according to claim 1, wherein the distal end of each of the plurality of baffles includes an inducing depression having a convexly curved surface for inducing a flow of the combustion gas drawn into the internal space, the inducing depression obliquely formed so that the convexly curved surface faces in a direction away from the mounting plate and toward the turbine disk.

4. The sealing structure according to claim 1, wherein each of the plurality of baffles includes:

a radially outer side surface extending from the mounting plate to the distal end;

a radially inner side surface extending from the mounting plate to the distal end; and a plurality of inducing holes for inducing a flow of the combustion gas drawn into the internal space, each of the plurality of inducing holes being formed through one of the plurality of baffles and having a first end communicating with the radially outer side surface and a second end communicating with the radially inner side surface, the first end disposed closer to the mounting plate than the second end such that each of the plurality of inducing holes is inclined.

5. The sealing structure according to claim 1, wherein the plurality of baffles protrude from one surface of the mounting plate in an upwardly inclined direction.

6. The sealing structure according to claim 1, wherein the plurality of baffles are formed on one surface of the mounting plate in an upwardly rounded shape.

7. The sealing structure according to claim 1, wherein the vane sealing assembly comprises:

a shroud coupled to a vane fixed to a casing for housing the turbine blade and the turbine disk; and a sealing housing coupled to the shroud and disposed between the turbine disk and another turbine disk adjacent to the turbine disk, and wherein the axially facing surface of the vane sealing assembly comprises:

a first surface facing the turbine disk; and a second surface facing the other turbine disk adjacent to the turbine disk.

8. The sealing structure according to claim 7, wherein the first surface of the vane sealing assembly includes a first axially facing surface of the sealing housing, and the second surface of the vane sealing assembly includes a second axially facing surface of the sealing housing, the first and second axially facing surfaces of the sealing housing formed on axially opposite sides of the sealing housing, and wherein the sealing structure is mounted on each of the first and second axially facing surfaces of the sealing housing, such that the plurality of baffles includes a first plurality of baffles protruding toward the turbine disk and a second plurality of baffles protruding toward the other turbine disk adjacent to the turbine disk.

9. A turbine comprising:

a rotor comprising a plurality of turbine disks and a plurality of turbine blades respectively coupled to an outer surface of each of the plurality of turbine disks;

a stator comprising a casing for housing the rotor, a plurality of vanes installed on an inner circumferential surface of the casing and disposed between the plurality of turbine blades, and a vane sealing assembly installed on an end of each of the plurality of vanes; and a sealing structure configured to prevent combustion gas passing through the plurality of turbine blades from being drawn into an internal space between a turbine disk of the plurality of turbine disks and the vane sealing assembly, the sealing structure comprising:

a mounting plate mounted to the sealing housing, the mounting plate having a planar shape and including a first mounting flange formed at a radially outer end of the mounting plate and a second mounting flange formed at a radially inner end of the mounting plate; and a plurality of baffles protruding from the mounting plate toward the turbine disk, the plurality of baffles spaced apart from each other and arranged in a radial direction between the first and second mounting flanges, wherein each of the plurality of baffles has a distal end disposed toward the turbine disk and a length measured from a surface of the mounting plate to the distal end, the respective lengths of the plurality of baffles being different from each other and gradually increasing from the radially outer end of the mounting plate to the radially inner end of the mounting plate, and wherein the plurality of baffles includes a shortest baffle disposed nearest the radially outer end of the mounting plate, wherein the vane sealing assembly comprises:

a shroud coupled to the end of one of the plurality of vanes; and a sealing housing configured to seal a gap between the turbine disk and another turbine disk adjacent to the turbine disk, the shroud coupled to the shroud, the sealing housing including a first surface facing the turbine disk and a second surface facing the other turbine disk adjacent to the turbine disk, and wherein the sealing structure is mounted on each of the first and second surfaces of the sealing housing.

10. The turbine according to claim 9, wherein the distal end of each of the plurality of baffles includes an inducing depression having a convexly curved surface for inducing a flow of the combustion gas drawn into the internal space, the inducing depression obliquely formed so that the convexly curved surface faces in a direction away from the mounting plate and toward the turbine disk.

11. The turbine according to claim 9, wherein each of the plurality of baffles includes:

a radially outer side surface extending from the mounting plate to the distal end;

a radially inner side surface extending from the mounting plate to the distal end; and a plurality of inducing holes for inducing a flow of the combustion gas drawn into the internal space, each of the plurality of inducing holes being formed through one of the plurality of baffles and having a first end communicating with the radially outer side surface and a second end communicating with the radially inner side surface, the first end disposed closer to the mounting plate than the second end such that each of the plurality of inducing holes is inclined.

12. The turbine according to claim 9, wherein the plurality of baffles protrude from one surface of the mounting plate in an upwardly inclined direction.

13. The turbine according to claim 9, wherein the plurality of baffles are formed on one surface of the mounting plate in an upwardly rounded shape.

14. A gas turbine comprising:

a compressor configured to draw in air and compress the drawn air;

a combustor configured to produce combustion gas by combusting a mixture of fuel and the compressed air; and a turbine comprising:

a rotor configured to be rotated by the combustion gas, the rotor comprising a plurality of turbine disks and a plurality of turbine blades respectively coupled to an outer surface of each of the plurality of turbine disks;

a stator comprising a casing for housing the rotor, a plurality of vanes installed on an inner circumferential surface of the casing and disposed between the plurality of turbine blades, and a vane sealing assembly installed on an end of each of the plurality of vanes; and a sealing structure configured to prevent combustion gas passing through the plurality of turbine blades from being drawn into an internal space between a turbine disk of the plurality of turbine disks and the vane sealing assembly, the sealing structure comprising:

a mounting plate mounted to the sealing housing, the mounting plate having a planar shape and including a first mounting flange formed at a radially outer end of the mounting plate and a second mounting flange formed at a radially inner end of the mounting plate; and a plurality of baffles protruding from the mounting plate toward the turbine disk, the plurality of baffles spaced apart from each other and arranged in a radial direction between the first and second mounting flanges, wherein each of the plurality of baffles has a distal end disposed toward the turbine disk and a length measured from a surface of the mounting plate to the distal end, the respective lengths of the plurality of baffles being different from each other and gradually increasing from the radially outer end of the mounting plate to the radially inner end of the mounting plate, and wherein the plurality of baffles includes a shortest baffle disposed nearest the radially outer end of the mounting plate, wherein the vane sealing assembly comprises:

a shroud coupled to the end of one of the plurality of vanes; and a sealing housing configured to seal a gap between the turbine disk and another turbine disk adjacent to the turbine disk, the shroud coupled to the shroud, the sealing housing including a first surface facing the turbine disk and a second surface facing the other turbine disk adjacent to the turbine disk, and wherein the sealing structure is mounted on each of the first and second surfaces of the sealing housing.

15. The gas turbine according to claim 14, wherein the distal end of each of the plurality of baffles includes an inducing depression having a convexly curved surface for inducing a flow of the combustion gas drawn into the internal space, the inducing depression obliquely formed so that the convexly curved surface faces in a direction away from the mounting plate and toward the turbine disk.

16. The gas turbine according to claim 14, wherein each of the plurality of baffles includes:

a radially outer side surface extending from the mounting plate to the distal end;

a radially inner side surface extending from the mounting plate to the distal end; and a plurality of inducing holes for inducing a flow of the combustion gas drawn into the internal space, each of the plurality of inducing holes being formed through one of the plurality of baffles and having a first end communicating with the radially outer side surface and a second end communicating with the radially inner side surface, the first end disposed closer to the mounting plate than the second end such that each of the plurality of inducing holes is inclined.

* * * * *